US007737811B2

(12) United States Patent
Trottmann et al.

(10) Patent No.: US 7,737,811 B2
(45) Date of Patent: Jun. 15, 2010

(54) ELECTROMECHANICAL SWITCHING DEVICE

(75) Inventors: Jürgen Trottmann, Falkenberg (DE); Markus Meier, Rieden (DE); Bertrand Viala, Karlsruhe (DE); Arndt-Peter Wolf, Dresden (DE)

(73) Assignee: Siemens Aktiengesellschaft, Munich (DE)

( * ) Notice: Subject to any disclaimer, the term of this patent is extended or adjusted under 35 U.S.C. 154(b) by 187 days.

(21) Appl. No.: 12/000,495

(22) Filed: Dec. 13, 2007

(65) Prior Publication Data

US 2008/0258851 A1 Oct. 23, 2008

(30) Foreign Application Priority Data

Mar. 28, 2007 (EP) ..... 07006443

(51) Int. Cl.
*H01H 9/02* (2006.01)
*H01H 13/04* (2006.01)

(52) U.S. Cl. ..... 335/202

(58) Field of Classification Search ..... 335/202; 174/17; 200/51

See application file for complete search history.

(56) References Cited

U.S. PATENT DOCUMENTS 3,215,800 A * 11/1965 Hurter et al. ..... 335/131
3,324,431 A * 6/1967 Kussy et al. ..... 335/132
5,834,998 A * 11/1998 Reiss et al. ..... 335/78
6,472,963 B1 * 10/2002 Liu et al. ..... 335/132
6,661,321 B1 * 12/2003 Chuang ..... 335/132
2003/0016105 A1 * 1/2003 Bauer et al. ..... 335/132

FOREIGN PATENT DOCUMENTS

| | | | |
|---|---|---|---|
| DE | 26 51 927 | | 5/1978 |
| DE | 100 13 353 | | 10/2001 |
| EP | 650014 | A1 * | 4/1995 |
| GB | 1581751 | A | 12/1980 |
| WO | WO 9512891 | A1 | 5/1995 |
| WO | WO 2005/101441 | | 10/2005 |

* cited by examiner

*Primary Examiner*—Elvin G Enad
*Assistant Examiner*—Mohamad A Musleh
(74) *Attorney, Agent, or Firm*—Harness, Dickey & Pierce, P.L.C.

(57) ABSTRACT

An electromechanical switching device of at least one embodiment includes fixed contacts securely arranged in a housing and a moving contact bridge for bridging the fixed contacts, a moving contact carrier to carry the contact bridge, and a solenoid to act on the contact carrier. In at least one embodiment the solenoid includes a coil body fixed to the housing, an armature coupled to the contact carrier so as to move with it, a yoke to act together with the armature, and a fixing mechanism, which engages with the yoke and coil body for fixing the yoke to the coil body.

16 Claims, 4 Drawing Sheets

ELECTROMECHANICAL SWITCHING DEVICE

PRIORITY STATEMENT

The present application hereby claims priority under 35 U.S.C. §119 on European patent application number EP07006443 filed Mar. 28, 2007, the entire contents of which is hereby incorporated herein by reference.

FIELD

Embodiments of the invention generally relate to an electromechanical switching device.

Examples of electromechanical switching devices include, for example, emergency stop switches, contactors or soft starters in automation technology, which, as a rule, are connected between a current source and a consumer such as electrical machines or drives.

Switching devices of this kind contain mechanical switching elements for transmitting or interrupting current, which are electrically actuated by a solenoid, which is present in the switching device. For example, a switching element of this kind in modern soft starters for electric motors is called a bypass. When a semiconductor switch in the soft starter is fully conducting, the semiconductor switch is galvanically bridged by mechanically closing the bypass in order to reduce the (semiconductor) power loss in the soft starter when the motor is running continuously.

A mechanical switching element contains a solenoid coil, which is securely fixed in the switching device, and a magnetic circuit driven by the solenoid coil consisting of yoke and armature, the yoke likewise being securely arranged in the housing or relative to the solenoid coil and the armature being movable. The armature is connected to a contact carrier, which carries moving contacts, which are brought into contact with fixed contacts, which in turn are secured to the housing, when the switching element closes. Other things also contained in the switching device include springs or spring plates. With regard to their geometric arrangement with respect to one another, all components of the electromechanical switching device must clearly be reliably arranged mechanically and electrically over the life of the device. In particular here, the yoke must be fixed in a stationary manner with respect to the solenoid coil or armature and the housing.

BACKGROUND

With known products, such as the 3RW40 Size S6 (MLFB: 3RW4055) soft starter or 3RT1023 Size S0 contactor made by Siemens AG, the yoke, exactly like the solenoid coil and coil body, is fixed to the housing of the switching device by a so-called yoke suspension. The yoke suspension includes sprung clamps, which encompass the yoke, for example, and which engage with the housing top part. FIG. 5 shows a switching device 110 of this kind in a rough schematic view. A coil 100 is fitted on a housing top part 102, e.g. clipped onto the housing top part. A yoke 104 is placed on the coil 100. Yoke holder 112 associated with yoke 104 is likewise fitted to the housing top part 102 in that the yoke holder 112 is sprung onto the housing top part with the help of sprung connectors 114. The coil 100 and yoke 104 are therefore both held to the housing top part.

It is also known to place the yoke on the coil body and to provide an insert part on the side of the yoke facing away from the coil body. All three components are then fixed between a housing top part and a housing bottom part, which are clipped together. In doing so, the housing top part can be formed in one piece with the coil body. An arrangement of this kind is shown in FIG. 4 as switching device 110 in a rough schematic view. Here, a coil 100 is fitted on a housing top part 102 or designed in one piece with said housing top part. A yoke 104 is placed on the opposite side of the coil 100. An insert part 106 is placed against the yoke 104. Coil 100, yoke 104 and insert part 106 are clamped or securely fixed in position between the two by means of a housing bottom part 108, which is clipped onto the housing top part 102. The remaining components of the switching device 110 are not shown in FIG. 4 for the sake of clarity.

The disadvantages of the known solutions are that, for example, sprung hooks for fixing the yoke must be provided by means of housing parts in the device, that the part complexity is high, as separate parts are necessary for clipping, that the yoke holders have an additional space requirement in the device, and that assembly errors, e.g. forgetting a yoke holder or a holding clamp, can occur.

SUMMARY

In at least one embodiment of the present invention, an electromechanical switching device is improved with regard to the secure fixing of the yoke in position in the switching device.

The object is achieved by way of an electromechanical switching device having fixed contacts securely arranged in a housing, and a moving contact bridge for bridging the fixed contacts. Here, the contact bridge is carried by a moving contact carrier. The contact carrier is moved by a solenoid acting thereon. The solenoid comprises a coil body, which is fixed to the housing of the switching device, an armature, which is coupled to the contact carrier so as to move with it, and a yoke acting together with the armature. According to at least one embodiment of the invention, the electromechanical switching device has a fixing mechanism, which engages with the yoke and coil bodies and is used for fixing the yoke to the coil body.

The yoke is therefore likewise secured in a fixed position with respect to the housing and the coil body, but is fixed directly to the coil body and not to the housing by way of the fixing mechanism. This results in one unit including solenoid coil and yoke, which can be already put together as a separate functional unit in a pre-assembly stage. This simplifies the assembly of the unit including the yoke and coil body in the housing and requires only a single fixing process.

The fixing mechanism can be designed integrally, in particular as one piece, with the coil body. The fixing mechanism is therefore part of the coil body, e.g. combined with the coil body in a further pre-manufacturing step or even designed with the coil body as one piece. The fixing mechanism can therefore not be forgotten. The yoke only has to be fixed to the coil body including the fixing mechanism.

The fixing mechanism can also have a holder for the yoke, which can be attached to the coil body. There therefore exists a separate component, a yoke holder, which likewise fixes the yoke to the coil body by way of the holder during pre-assembly. The presence of the yoke holder and its correct assembly can already be checked before assembling the switching device however, and this is therefore easier.

The fixing mechanism can have a latch, which engages after fixing the yoke. The yoke or the fixing mechanism must then only be clipped to or engaged with the coil body or vice versa. An additional step, such as screwing, gluing, crimping or similar, is not required.

The fixing mechanism can have latching lugs, which are designed in one piece with the coil body and which engage behind the yoke in the fixed state. In this way, the yoke can be fixed to the coil body particularly easily by moving it onto the coil body and in doing so moving the latching lugs outwards, i.e. out of their latching position. Only when the yoke is fully pressed on do the latching lugs spring back into their original position thereby engaging behind the yoke and fixing it.

The fixing mechanism can include a cage, which encloses the yoke in the fixed state between itself and the coil body, and which has pressure elements, which are arranged in the form of a cross, for example. Each pressure element then exerts pressure on the yoke in the direction of the coil body in its own right, as a result of which said yoke is pressed centrally onto the coil body.

It can be possible to clip a cage of this kind onto the coil body. The fixing of the cage is also solved particularly easily in this way and requires no further step such as the above-mentioned screwing etc.

BRIEF DESCRIPTION OF THE DRAWINGS

For a further description of the invention, reference is made to the example embodiments set forth below and in the drawings. In the drawings, in a schematic principle diagram in each case.

DETAILED DESCRIPTION OF THE EXAMPLE EMBODIMENTS

Figure 1:
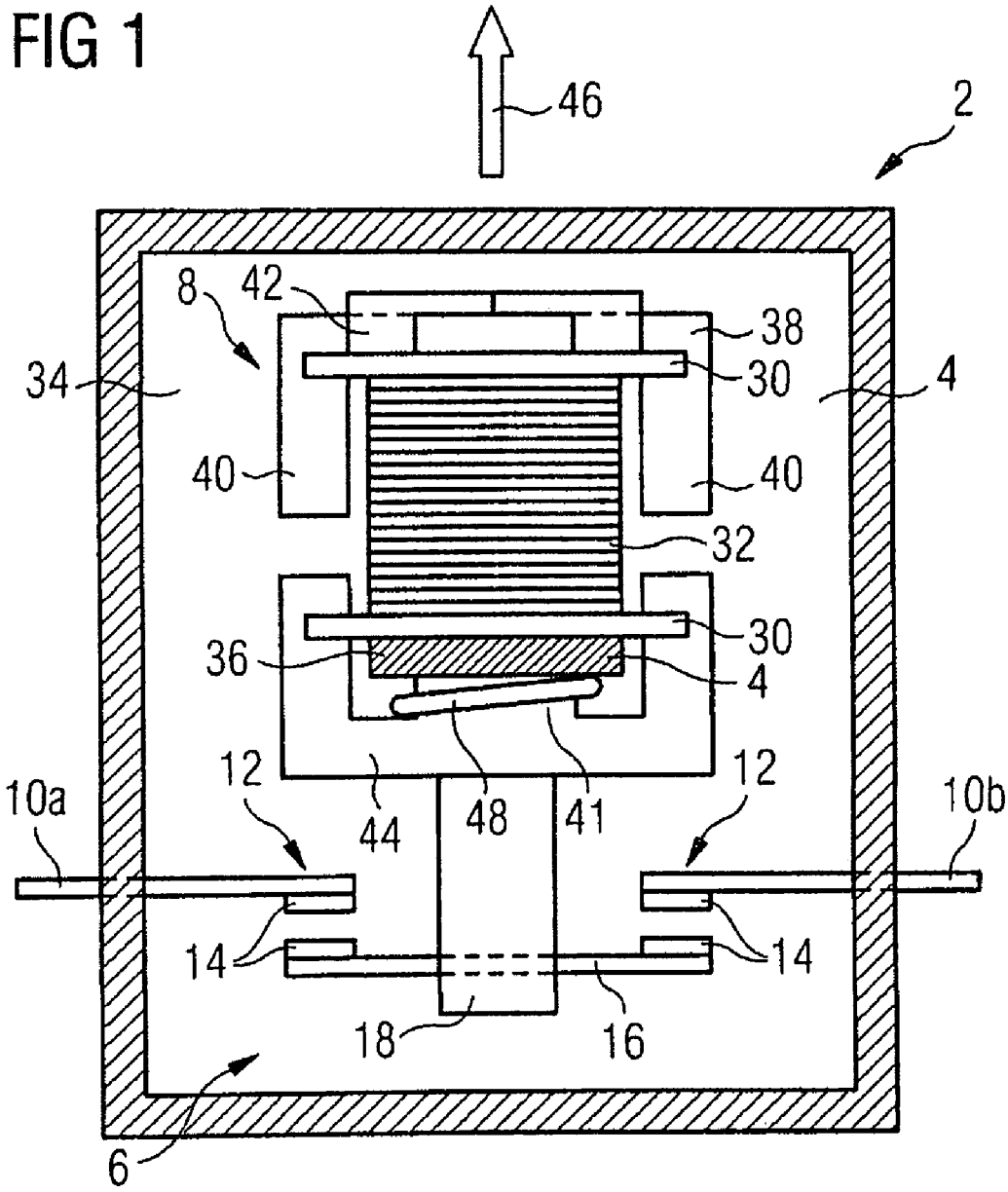
FIG. 1 shows an electromechanical switching device, the housing of which is cut open.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described. Like numbers refer to like elements throughout. As used herein, the terms "and/or" and "at least one of" include any and all combinations of one or more of the associated listed items.

In a highly simplified diagram, FIG. 1 shows a switching contactor 2 having a housing 4, which is cut open in order to be able to see into the inside of the switching contactor 2. In the housing 4 are arranged a switching element 6 and a solenoid 8, which actuates the switching element 6. The switching element 6 includes two fixed contacts 10*a, b*, which penetrate the wall of the housing 4 and which each carry contact buttons 14 at their ends 12 inside the housing. Further contact buttons 14, which are arranged on a moving contact 16, are associated with each of the contact buttons 14. The moving contact 16 is fixed in a moving contact carrier 18.

The solenoid 8 includes a coil body 30 on which an electrical coil 32 is wound. Part of the housing 4 in the form of a mounting tongue 36 extends from the rear wall 34 of the housing 4 visible in FIG. 1 into the inside of the switching contactor 2, i.e. towards the observer in FIG. 1. The coil body 30 is securely mounted, e.g. clipped, on the mounting tongue 36, and is therefore securely fixed in position relative to the housing 4. An E-shaped yoke 38 is fed into the coil body 30 by means of its central projection (not visible in FIG. 1) so that the two outer legs 40 of the yoke 38 point past the sides of the coil body 30 in the direction of the switching element 6. A yoke holder 42 encompasses the yoke 38 and fixes said yoke to the coil body 30 in that the yoke holder 42 is securely mounted to the coil body 30, e.g. clipped onto said coil body. In doing so, the fixing grips close to the yoke 38 taking the shortest possible path, namely to the end of the coil body 30 facing the yoke 38.

Coil body 30, coil 32, yoke 38 and yoke holder 42 are therefore securely fixed in position to the housing 4 by way of the mounting tongue 36. An E-shaped armature 44 is mounted on the side of the coil body 30 opposite the yoke 38 in order, together with the coil body 30, to form a magnetic circuit of the solenoid 8. The middle leg 41 of the armature 44 projects into the inside of the coil 32. The armature 44 is securely connected to the contact carrier 18 and therefore coupled to the contact carrier and to the contact 16 or the contact buttons 14 so as to move with them. The armature 44 can be moved in the direction of the arrow 46 or in the opposite direction.

In FIG. 1, the coil 32 is not energized and the armature 44 is pre-stressed in the opposite direction of the arrow 46, that is to say in the opening direction of the contact buttons 14, by a spiral spring 48, which is supported on the armature 44 and on the mounting tongue 36. It is therefore in its end position in the open position. The switching contactor 2 is open and there is no electrical contact between the fixed contacts 10*a, b*.

By energizing the coil 32, a magnetic circuit is produced in yoke 38 and armature 44, which moves the moving armature 44 relative to the housing 4 in the direction of the arrow 46 and thus brings the contact buttons 14 into mutual contact. The electrical contact between the fixed contacts 10*a, b* is therefore made.

Figure 2:
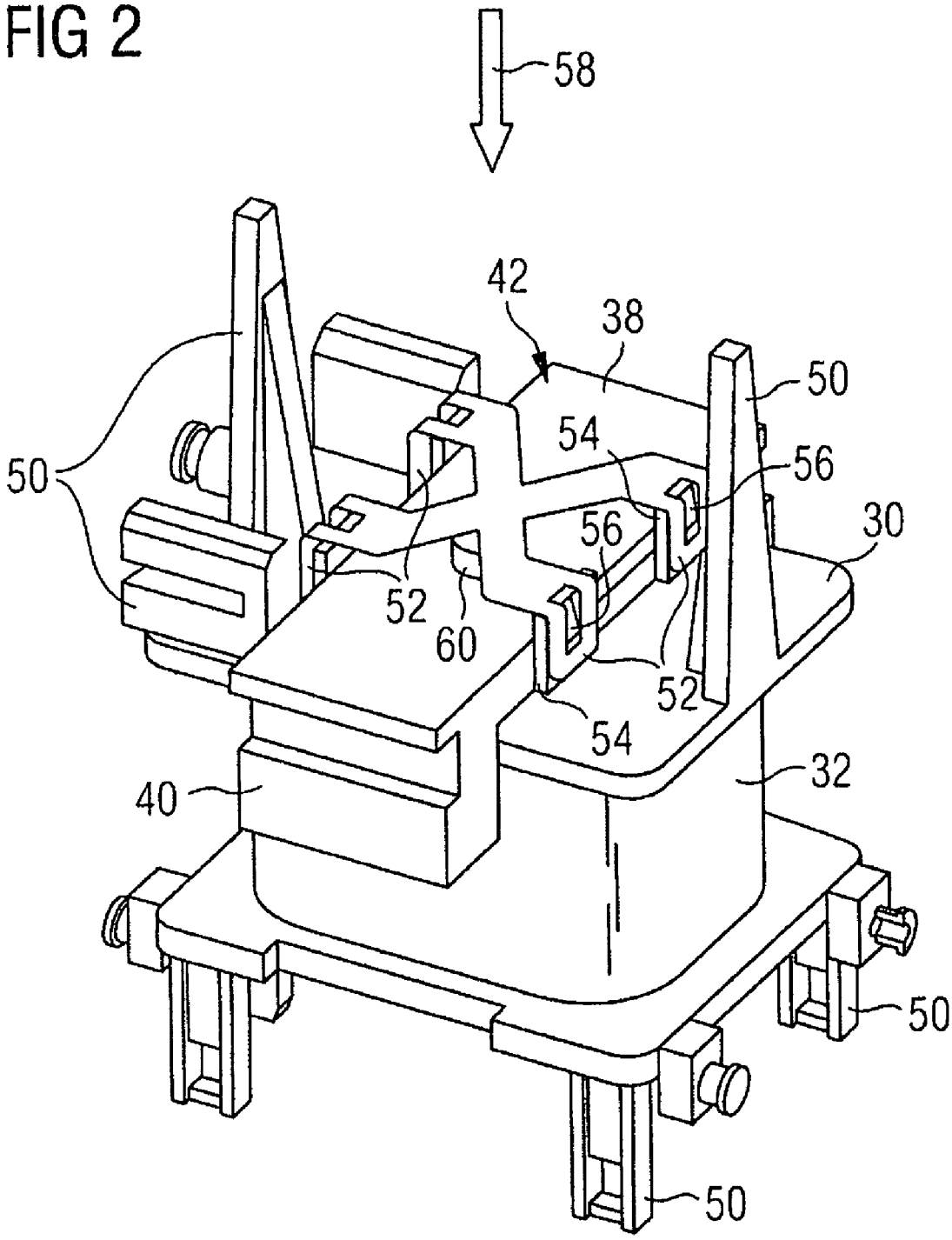
FIG. 2 shows a solenoid coil with yoke and clipped-on fixing cage.

FIG. 2 shows the coil body 30 from FIG. 1 in a more detailed diagram together with the coil 32, the yoke 38 and the yoke holder 42. In contrast to the highly simplified diagram in FIG. 1, several structural elements 50, which are molded onto the coil body 30 and which are all used to anchor the coil body 30 in the housing 4, can be seen in FIG. 2.

It can also be seen that the yoke holder 42 is designed in the form of a cage, which is fixed to the coil body 30 at four points 52. The fixings are designed in the form of latching lugs 54, which are molded onto the coil body and engage in corresponding openings 56 of the yoke holder 42 when the yoke holder is pressed onto the coil body 30 and the positioned yoke 38 in the direction of the arrow 58 during assembly. In the clamped state shown in FIG. 2, the yoke holder 42 exerts pressure in the direction of the arrow 58 on the yoke 38 by way of a pressure part 60 and presses said yoke against the coil body 30.

Figure 3:
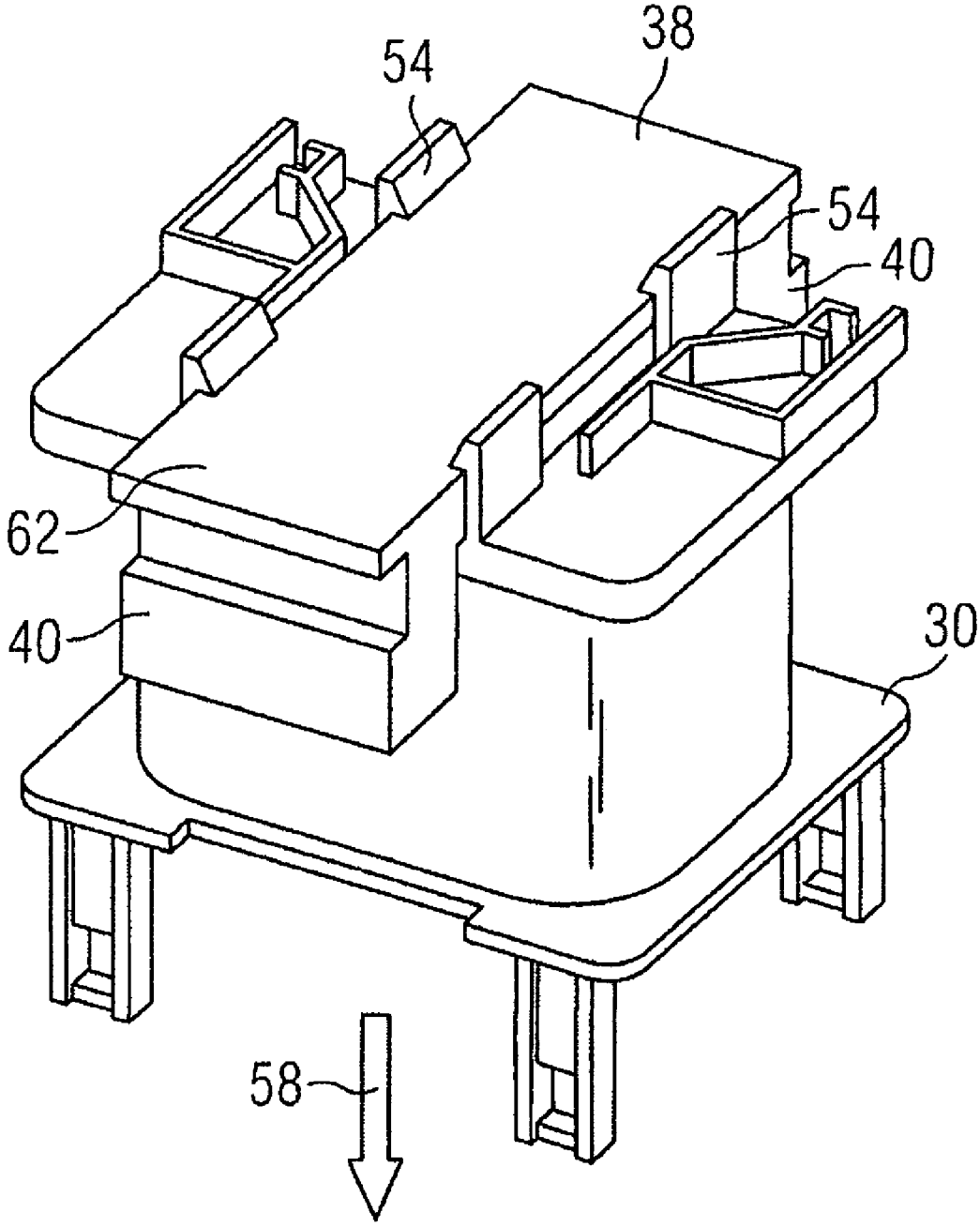
FIG. 3 shows a solenoid coil with molded-on fixing mechanism.
Figure 4:
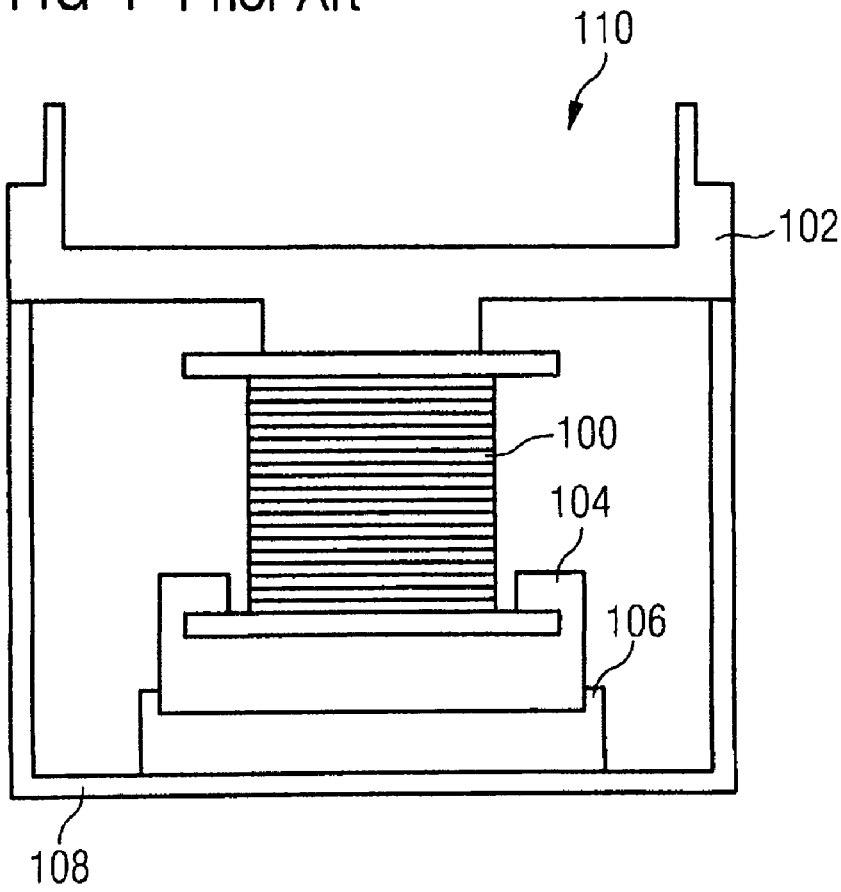
FIG 4 Prior Art
FIG. 4 shows a yoke, which is fixed according to the prior art by pressing between housing halves.
Figure 5:
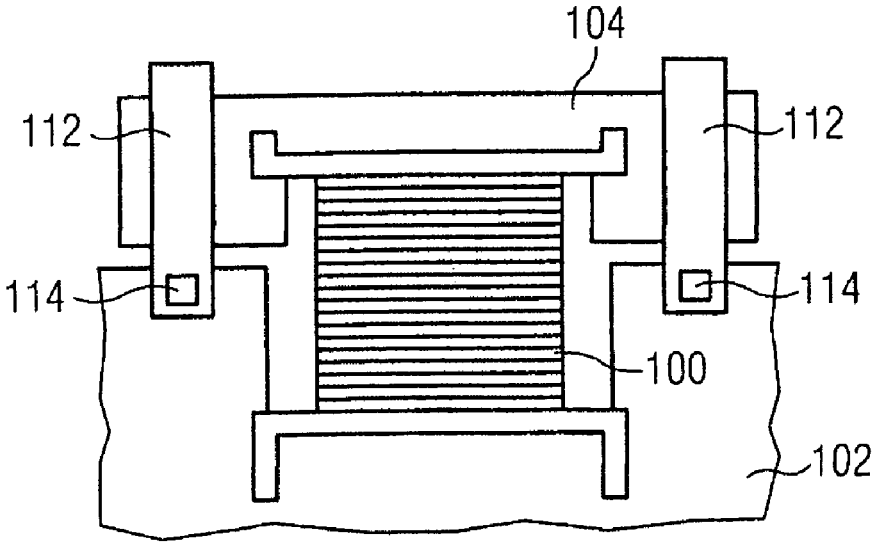
FIG 5 Prior Art
FIG. 5 shows an alternative yoke, which is fixed according to the prior art by fixing to a housing part.

FIG. 3 shows an alternative embodiment of a coil body 30, on which latching lugs 54 are again molded. However, these are not used to fix a yoke holder 42 as in FIG. 2, but act directly on the yoke 38. When the yoke 38 is fitted to the coil body 30 in the direction of the arrow 58 during assembly, the latching lugs 54 move apart before the yoke 38 and do not latch behind the top 62 of the yoke holder 38 in order to fix said yoke holder permanently to the coil body 30 until the yoke is in the end position against the coil body 30 shown in FIG. 3. Compared with the solution shown in FIG. 2, the solution shown in FIG. 3 is only suitable for smaller hold-down forces of the yoke 38 on the coil body 30. In return, a separate yoke holder 42 is not necessary in the embodiment according to FIG. 3.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electromechanical switching device comprising:

fixed contacts securely arranged in a housing;

a moving contact bridge to bridge the fixed contacts;

a moving contact carrier to carry the contact bridge; and a solenoid, to act on the contact carrier, including a coil body fixed to the housing, an armature coupled to the moving contact carrier so as to move with the contact carrier, a yoke to act together with the armature, and a fixing mechanism that protrudes from a surface of the coil body and contacts the yoke and coil body to fix the yoke to the coil body wherein the fixing mechanism includes latching lugs, the latching lugs being designed in one piece with the coil body that engages and latch with the surface of the yoke in a fixed state.

2. The switching device as claimed in claim 1, wherein the fixing mechanism includes a portion of the coil body that extends from a top surface of the coil body.

3. The switching device as claimed in claim 2, wherein the fixing mechanism is designed as one piece with the coil body.

4. The switching device as claimed in claim 2, wherein the fixing mechanism includes a latch to engage after fixing the yoke.

5. The switching device as claimed in claim 2, wherein the fixing mechanism includes a cage, that contacts at least a top surface and a side surface of the yoke in the fixed state.

6. The switching device as claimed in claim 5, wherein the cage is attached onto the coil body by a clip mechanism.

7. The switching device as claimed in claim 1, wherein the fixing mechanism includes a holder for the yoke, attachable to the coil body.

8. The switching device as claimed in claim 7, wherein the fixing mechanism includes a latch to engage after fixing the yoke.

9. The switching device as claimed in claim 7, wherein the fixing mechanism includes a cage, that contacts at least a top surface and a side surface of the yoke in the fixed state.

10. The switching device as claimed in claim 9, wherein the cage is attached onto the coil body by a clip mechanism.

11. The switching device as claimed in claim 1, wherein the fixing mechanism includes a latch to engage after fixing the yoke.

12. The switching device as claimed in claim 1, wherein the fixing mechanism includes a cage, that contacts at least a top surface and a side surface of the yoke in the fixed state.

13. The switching device as claimed in claim 12, wherein the cage is attached onto the coil body by a clip mechanism.

14. The switching device as claimed in claim 1, wherein the fixed contacts penetrate walls of the housing.

15. The switching device as claimed in claim 1, further comprising a spring between the armature and the coil body.

16. The switching device as claimed in claim 1, wherein coil body, coil, yoke and fixing mechanism are fixed to the housing by way of a mounting tongue that extends from a rear wall of the housing.

* * * * *